US007014191B2

(12) United States Patent
Nasco

(10) Patent No.: US 7,014,191 B2
(45) Date of Patent: Mar. 21, 2006

(54) MULTI-PLAYER CARD GAME AND METHOD OF PLAYING THE SAME

(76) Inventor: Ronald Nasco, 507 E. Alpine Dr., Payson, AZ (US) 85541

( * ) Notice: Subject to any disclaimer, the term of this patent is extended or adjusted under 35 U.S.C. 154(b) by 88 days.

(21) Appl. No.: 10/910,446

(22) Filed: Aug. 3, 2004

(65) Prior Publication Data

US 2005/0051967 A1 Mar. 10, 2005

Related U.S. Application Data

(63) Continuation-in-part of application No. 10/300,952, filed on Nov. 20, 2002, now abandoned.

(51) Int. Cl.
*A63F 1/00* (2006.01)
*A63F 1/18* (2006.01)

(52) U.S. Cl. ..... 273/292; 273/273; 273/249

(58) Field of Classification Search ..... 273/249, 273/273, 292–308

See application file for complete search history.

(56) References Cited

U.S. PATENT DOCUMENTS 952,393 A * 3/1910 Parker ..... 294/68.25
5,791,652 A * 8/1998 Nielsen ..... 273/305
5,863,043 A * 1/1999 Bitner ..... 273/299
6,598,880 B1 * 7/2003 Addabbo ..... 273/306

OTHER PUBLICATIONS

Diagram Group, "The Way To Play The Illustrated Encyclopidia Of The Games Of The World", Paddington Press LTD, pp. 112–113 and 120–121.*

* cited by examiner

*Primary Examiner*—Jessica Harrison
*Assistant Examiner*—Dmitry Suhol
(74) *Attorney, Agent, or Firm*—Starkweather & Associates; Michael W. Starkweather; Jason P. Webb

(57) ABSTRACT

A portable multi-player card game having a unique set of playing cards and a unique system for scoring and keeping track of score, wherein the method of playing is distinct from cribbage based card games. A game board is provided, having a card holder portion and a score board portion; wherein, the score board portion includes a games won section and a points scored section. Both of these sections include three scoring rows. Within each scoring row are one or more rows of peg holes within which the scorekeeper keeps track of the number of points accumulated by each player, or team of players. Scoring occurs as players' cards are matched to cards of identical color, or to cards depicting other images or numbers, in a central pile. The object is to score eleven points and win an individual game. Whoever wins three games first wins the entire game.

6 Claims, 4 Drawing Sheets

MULTI-PLAYER CARD GAME AND METHOD OF PLAYING THE SAME

This is a continuation in part of application Ser. No. 10/300,952, filed Nov. 20, 2002, now abandoned having the same title and inventor as the present application.

BACKGROUND OF THE INVENTION

1. Field of the Invention

The present invention relates generally to card games. Specifically, this invention teaches a portable multi-player card game having a unique set of playing cards, a system for storing game pieces and game cards, a unique system of determining scores, and a method of score keeping. The present invention may be enjoyed by card game enthusiasts who travel often or otherwise require game portability.

2. Description of the Prior Art

Methods of playing card games, particularly cribbage, which use cards and scoring boards for scoring points are well known in the prior art. For example, U.S. Pat. No. 6,257,577 discloses a game of cribbage and method of playing the same for adding an additional element of strategy to cribbage. This patent teaches a game board having a predetermined path for scoring points and a deck of cards for use in playing cards in accordance with traditional rules of cribbage, adding minor variations.

Further examples of prior patents in the general area of cribbage-type card games are outlined below. Each of these references is incorporated by reference for its supporting teachings:

U.S. Pat. No. Des. 223,714 to Kester discloses an ornamental design for a combined game board and chip holder;

U.S. Pat. No. Des. 322,638 to Levy et al. discloses an ornamental design for a combination chip and card holder and scorer therefor;

U.S. Pat. No. Des. 354,920 to Moradinia discloses an ornamental design for a combined game board and container;

U.S. Pat. No. 2,288,671 to Batchelder discloses a combined case and cribbage board;

U.S. Pat. No. 5,090,106 to Fink discloses a method of manufacturing a scoring board;

U.S. Pat. No. 5,491,324 to Vanderpool discloses a score-keeping-with-carry score board;

U.S. Pat. No. 5,590,883 to Brewer discloses a cribbage game; and

U.S. Pat. No. 5,952,637 to Strunk discloses a portable folding board game.

Each of these prior patents disclose improvements in the general area of games. However, none of the foregoing references disclose a portable multi-player card game having a unique set of playing cards and a unique system for scoring and keeping track of score. Most of the prior art patents are variations on common and well known cribbage rules, not able to provide a new and uniquely challenging method of playing cards.

SUMMARY OF THE INVENTION

The present invention provides a portable multi-player card game having a unique set of playing cards and a unique system for scoring and keeping track of score wherein the method of playing is distinct from cribbage based card games.

The present invention departs from commonly known cribbage based card games by providing a game board, having a card holder portion and a score board portion; wherein, the score board portion includes a games won section and a points scored section. Both of these sections include three scoring rows. Within each scoring row are one or more rows of peg holes within which the scorekeeper keeps track of the number of points accumulated by each player or team of players.

Scoring occurs as players' cards are matched to cards of identical color, or to cards depicting other images or numbers, in a central pile. The object is to score eleven points and win an individual game (score is kept via the scoreboard portion, wherein pegs are placed in corresponding number holes). Whoever wins three games first wins the entire game.

Additional features and advantages of the invention will be set forth in the detailed description which follows, taken in conjunction with the accompanying drawings, which together illustrate by way of example, the features of the invention.

BRIEF DESCRIPTION OF THE DRAWINGS

The invention might be better understood when viewed in consideration of the following detailed drawings, wherein like parts are designated with like numerals throughout. Such drawings include.

DETAILED DESCRIPTION OF THE PREFERRED EMBODIMENT(S)

The presently preferred embodiments of the invention will be best understood by reference to the drawings, wherein like parts are designated with like numerals throughout.

Figure 1:
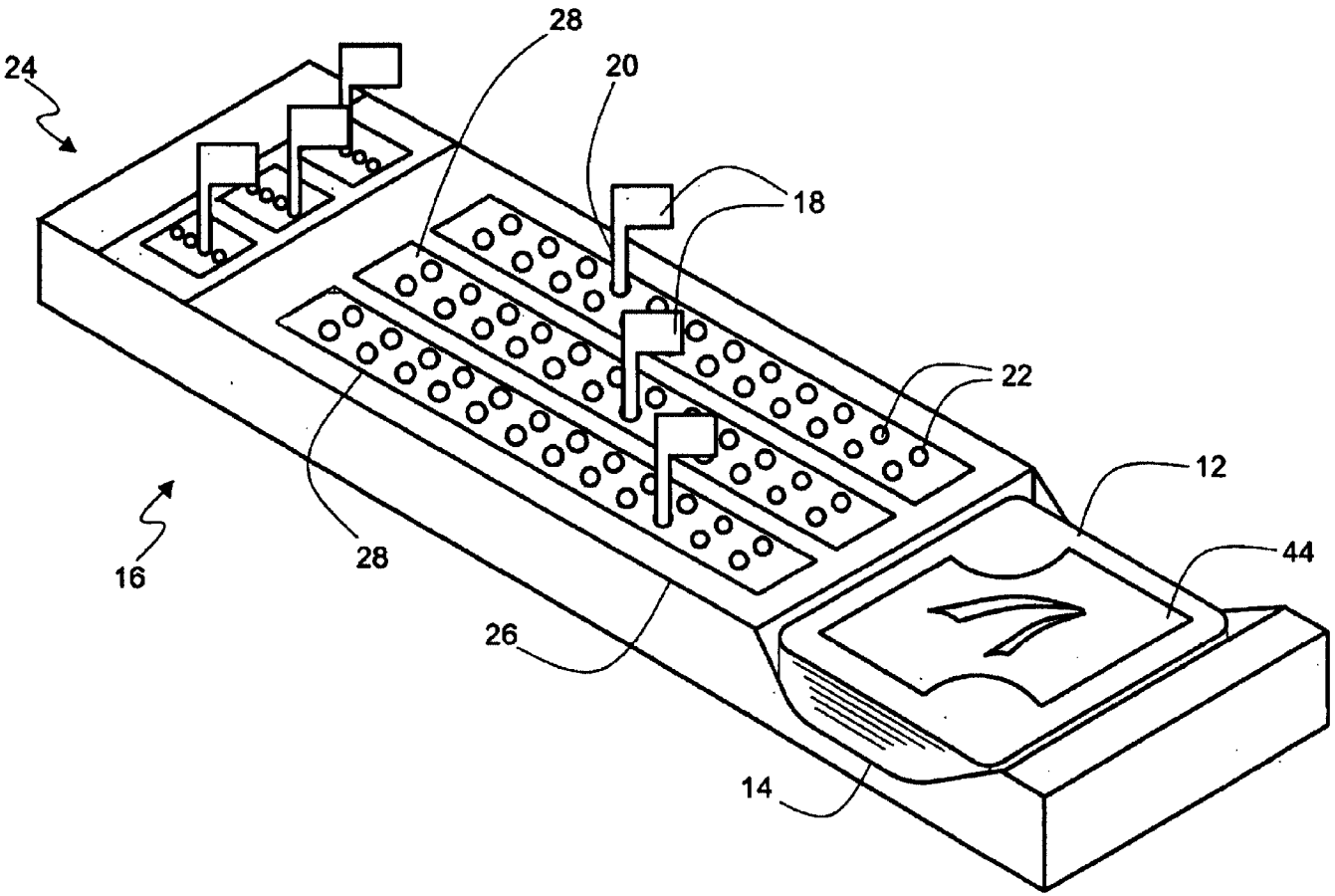
FIG. 1, which shows a top perspective view of an embodiment of the game score board and card holder 10.
Figure 2:
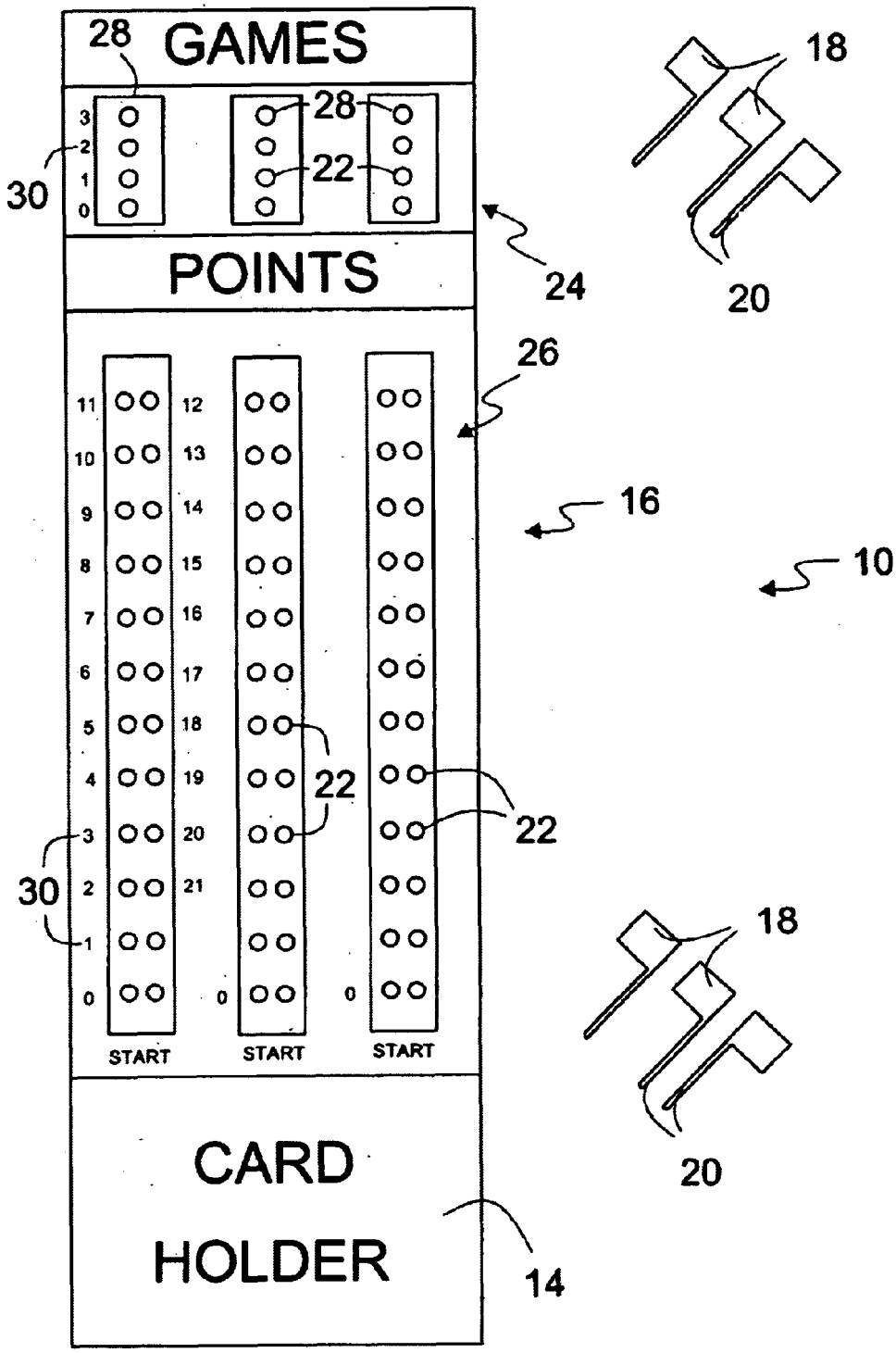
FIG. 2, which shows a top plan view of an embodiment of the score board and card holder 10 according to the present invention.

Referring to FIGS. 1 and 2, there is shown a game card holder and score board 10 according to the present invention. The card holder and score board 10 includes two parts: a card holder portion 14 and a score board portion 16. The card holder portion 14 is shown holding the game playing cards 12.

The score board portion 16 includes a games won section 24 and a points scored section 26. Both of these sections 24, 26 include three scoring rows 28. Within each scoring row 28 are two rows of peg holes 22 upon which a scorekeeper (not shown) keeps track of the number of points accumulated by each player.

Each player or team is designated by a peg 20. As points are accumulated, the scorekeeper moves a player's peg 20 to correspond with a number 30 on a side of the scoring row 28.

Figure 3:
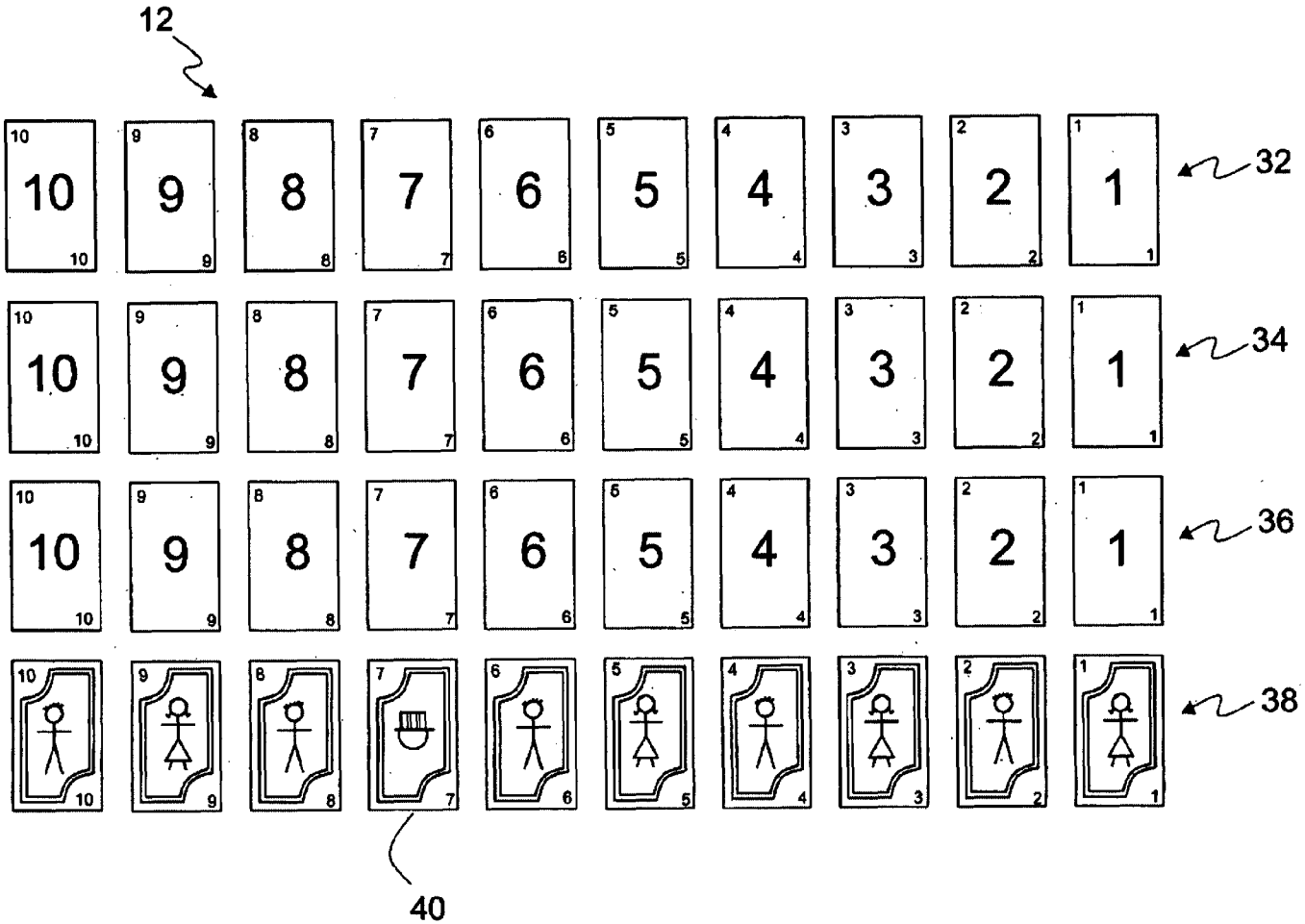
FIG. 3, which shows a top plan view of an embodiment of the playing cards 12 according to the present invention.

In FIG. 3, different suits of cards 12 are represented. Among a top row of cards 32, a first suit of cards may be coded in a particular color. In one embodiment, this suit is red. The next row down represents a second suit of cards 34. In one embodiment, this suit is blue. The next row down from the previous row 34 represents a third suit of cards 36, which in one embodiment is green. The bottom row represents a picture suit of cards 38. Included in the picture suit 38 is a chief card 40. In one embodiment, numbers 41 on the picture suit 38 are black.

Figure 4:
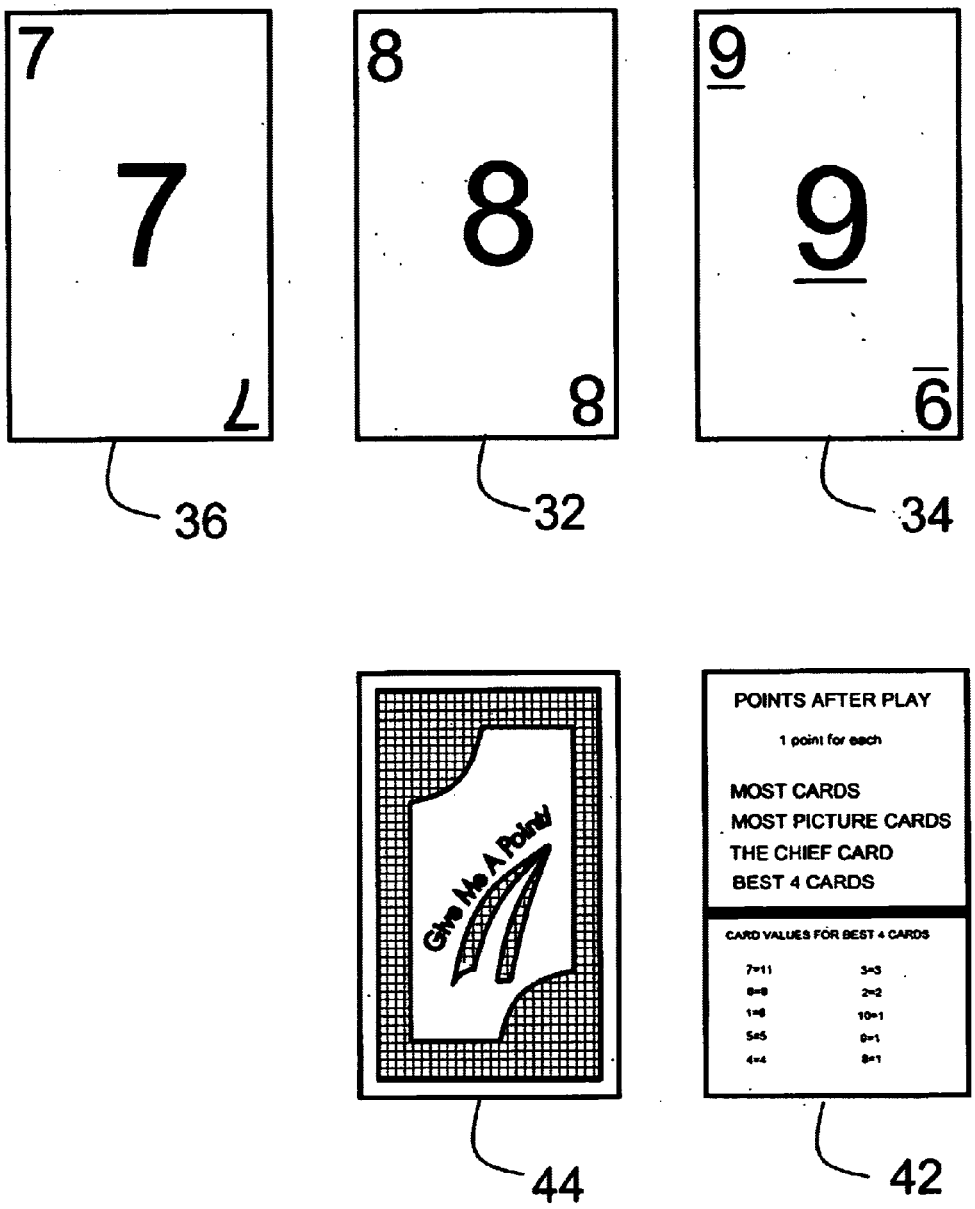
FIG. 4, which shows a top plan view of a different embodiment of the playing cards 12 according to the present invention.

FIG. 4 shows a series of card designs according to one embodiment of the present invention. Reference number 44 shows a design for a back face of the cards 12. Reference number 42 shows a design for a helper card.

Referring now to a method of playing the card game, the following is an illustration of how a hypothetical four player game can be played under the rules of the present invention:

A player shuffles the set of playing cards 12 and deals one card to each person (beginning with the player on his left) face up to see who becomes the first dealer. The first person to be dealt a picture card becomes the dealer. The selected dealer is then given the card holder and scoreboard 10 and commences dealing the cards to the players (beginning at the dealer's left). The dealer may offer the cards to the person to the right to cut the cards. Like in many card games, the person chooses whether to cut them or not.

Three cards from the set of playing cards 12 are dealt to each player and four cards are placed on a table face up. When dealing to the players, the cards are dealt one card at a time and face down. The four cards placed on the table are laid face up. The dealer chooses how to deal the four cards on the table (e.g. the dealer can choose to wait until all the cards are dealt to the players and then put four cards up; or alternatively, the dealer can put one card face up on the table and then one to each player, etc.). The remaining cards are placed in the card-holder portion 14 until the next hand is dealt. If two "10's" are dealt face up to the center pile, the cards are thrown in, and the same dealer re-deals a new hand.

To begin play, the player to the left of the dealer determines whether they have a card that matches one of the four cards on the table (also called a card in the center pile). If the player does have a card that matches one of the center pile, then that player can pick the card that matches up and put it, along with his matching card, in front of him face down (in his card pile or trick pile).

It is noted that the cards 12 that are in the center of play are not stacked one on top of the other, they are all spread out so the player can pick from any of the four. In other words, if the player has a card that matches any of the four, he can take the trick.

It is also noted that if the player has two cards that match two of the cards on the table, the player can select either. The potential advantage to taking one trick over the other relates to the points that can be earned at the end of play. As will be further discussed below, at the end of play, there are points that can be earned based on the cards that a player has in his trick pile. For example, a point is given to whoever has the most cards; a point is given to whoever has the most picture cards 38; a point is given to the person that has the picture card with the "7" on it, also called the Chief card 40; and a point is given for the best four cards. So, as a matter of strategy, if given a choice between a picture card and a non-picture card, it may be advantageous to select the picture card because it could be beneficial in earning the points for having the most picture cards. As another example, if the "7" picture card (the Chief card 40) is on the table and another "7" is on the table, for example a red "7", it would be advantageous to pick the seven that has the picture card on it because that is worth one point, which is immediately awarded to the player.

If the player who's turn it is does not have a card that exactly matches one of the four cards on the table, that player can add the cards on the table to match one of his cards. To illustrate, if the player has a "10", but there is no "10" in the center pile, then that player can select any combination of cards that add up to ten. For example, if there is a "7" and a "3", the player could take both of those cards and add them to his trick pile. Similarly, if there is a "5", "4" and "1", the player can take all these cards and add them to his trick pile (as a strategy, if faced with either choice, it may be advantageous to select the trick that gives you three rather than two cards—thus the player would be better off for earning the points awarded for the most cards).

However, it is noted that if a player has an "8" card in his hand, and there is "3", "5" and "8" in the center pile, that player cannot take the "5" and "3" instead of the "8". Rather, that player must take the natural "8". In other words, a player cannot pick a combination of cards if there is a natural card on the table.

If the first player is unable to match any single card or combination of cards from the center pile with a card in his hand, he must discard one of his cards to the center pile. The effect of this is that the center pile can keep growing. Using the example of a four player game above, if the first player was forced to discard, then the second player would have five cards in the center pile to try to match to a card in his hand.

Each player in turn plays in a similar manner, with play moving in a clockwise direction. Every player picks up a card, or set of cards, off of the table (the center pile) that matches a card in their hand. If they don't have a matching card, they must discard a card to the center pile. Once all three cards are played by all the players, a new hand is dealt. This entails dealing three more cards to each player, again, one at a time and face down. No additional cards are dealt into the center pile. Each time, after all the players' cards have been played, three more cards are dealt until all the cards 12 have been dealt out.

With regard to the center pile, a player who is able to take the remaining cards in the center pile is immediately awarded a point. To illustrate, if at a point in the game there is a "5" and a "3" on the table and the current player has an "8" in his hand, he may take the "5" and "3", along with his "8", and place them in his trick pile. Since there are no cards remaining in the center pile, the current player is immediately awarded a point. Each player who is able to take the last card off the table or center pile is immediately awarded a point. In one embodiment of the present invention, the current player says to the scorekeeper, "give me a point." The scorekeeper/dealer then takes the peg 20 and scores a point for that player.

It is noted that points scored for taking the remaining card(s) out of the center pile and for taking the Chief card 40 are the only points awarded during play of the game. In other words, all remaining points that are awarded are given after all the cards have been dealt and played. As noted above, after all cards have been dealt and played, points are awarded for the most cards, the most picture cards, and the best four cards. Points are awarded one at a time and in the order described above.

Once all the cards 12 have been taken from the center pile, the player who's turn it is, or player 1, then must discard one of his cards (this is of necessity because there are no possible matches in the center pile with the player's cards). The next player, or player 2, now has a chance to get a point if she has the same card that was placed in the center pile by player 1. If she, in fact, does have that card in her hand, she will take that card and add it to her trick pile and be awarded a point.

If player 2 does not have a matching card, she will be required to discard a card into the center pile.

If player 2 was able to take the trick (i.e. take the card laid down by player 1), then player 3 will be required to discard into the center pile because there are no cards in the center pile, and thus no possibility for matches. If player 2 could not take the trick, but was forced to discard, then player 3 tries to match a card with either one of the cards in the center pile or the cards in combination.

It is noted that, as discussed above, every time the players have either played or discarded all the cards from their hands, three new cards are dealt to each player. No additional cards are dealt into the center pile. Play continues in this manner until all the cards have been dealt.

Once all the cards 12 have been dealt, and the last player is to play his last card, if he can match his last card with any single card or combination of cards remaining in the center pile he adds those cards to his trick pile. If the last player is able to take all the remaining cards from the center pile, he is immediately awarded a point. If he cannot match his card up with any of the cards (singly or in combination) in the center pile, he must discard his last card. The remaining cards are then given to the last person that took a trick off that table (i.e. the last person who matched one of his cards with one or more cards in the center pile).

It is noted that these last cards could be given to the last player where the last player had a card that matched one or more cards in the center pile, but did not clear out the center pile, because that player would still be the last player to win a trick and would get the cards remaining in the center pile. It is also noted that no point is awarded to the player who gets the remaining cards out of the center pile simply by virtue of taking the last trick. In other words, as discussed above, a player is immediately awarded a point when he takes a trick that clears out the center pile. However, no point is awarded to a player who only gets the remaining cards because he was the last one to take a trick before the hand ended.

After play has concluded, points are awarded, one point at a time in the following order: one point for the player holding the most cards 12, one point for the player holding the most picture cards 38, and one point for the player holding the best four cards. In the event of a tie in most cards, most picture cards 38, and best four cards, no player is awarded those points.

It is also noted that in the best four cards category, points are awarded for the best four cards of different suits. In other words, it is the player that has the highest value red, green, black and blue combined. If a player does not have all four colors in his hand, he is not eligible to compete for the best four card award.

In a preferred embodiment, the winner of the game is the first player to score eleven points. Thus, each point must be determined in the order described above, because the first player to reach eleven points wins the game. Score is kept via the scoreboard portion 16, wherein the pegs 20 are placed in the corresponding number holes 22. The number of games won is recorded in the games won section 24 of the card holder and score board 10. This, as noted above, is recorded by placing pegs 20 corresponding to the player or team in the appropriate number hole 22. After all cards have been dealt and played, the hand is over and the points are counted. After all the points have been counted and recorded, the card holder and score board 10 is passed to the player who is sitting to the left of the dealer. The new dealer shuffles the cards and deals a new hand—three cards one at a time face down and four cards face up to the center pile. In this manner, every player gets an opportunity to keep score and deal. Whoever wins three individual games first wins the entire game.

To assist the reader in understanding the game play, the following directions would be placed in the game and are provided herewith:

1. Start/Deal—three cards are dealt face down to each player and four cards face up on the table.

2. Play—Players in turn try to match the features/numbers of a card held in their hand to those of the cards face up on the table. If unable to pick/match they must discard one card from their hand.

3. When all three cards have been played by all players, three additional cards are dealt face down to each player (no cards are dealt face up to the table).

4. Repeat step 3 until the entire deck of cards has been dealt. When the entire deck has been dealt and played, the hand is over. NOTE—all cards that are left face up on the table, after all cards have been dealt and played, are given to the last player to take a trick. (this is not considered clearing the board and no point is given at this time). The points after play are determined and scored. The cards and pegboard are passed to the player to the left of the previous dealer. The cards are and shuffled and a new hand of 3 face down to each player and 4 face up to the table is dealt).

5. Points are scored both during play and after play (after play means all cards in the deck have been dealt and played).

6. Points during play—each time a player takes a trick (matches a card/cards) that clears the table (leaves no cards face up) they immediately score a point. There is no limit to the number of points that can be scored this way. One point is also awarded to the player that captures the "Chief" card. (this can be done in several ways.)

A. If held in a players hand, it can be matched with a card/s of the same value on the table.

B. If on the table, a player can take it with a card of equal value from his hand.

C. If it is still face up on the table after the entire deck has been dealt and played, the last player to take a trick gets all the remaining cards and gets the point for the "Chief" card.

7. Points after play—1 point is given to the player that has the most cards. 1 point is given to the player that has the most cards with a predetermined feature.

8. Optional play—{This is a point after play). 1 point is given to the player with the best 4 cards in their trick pile. This is determined by taking the highest value card in each of the 4 suits/colors. The player with the highest total gets the point.

VARIATIONS OF THE INVENTION

It is understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. For example, in one embodiment the peg 20 may include a flag 18 attached to an upper end of the peg 20 for more clearly denoting the location of the peg 20 on the score board portion 16. In another embodiment, instead of the winner being the first to score eleven, the winner is the first to score twenty-one, or any other designation of winning points. Although the present embodiment illustrates a single set of pictures for the picture cards 38, it is contemplated to customize these images. For example, one skilled in the art may now consider placing family photos, cartoons, movie images, sports players, or new events thereon. This might give the players an added interest in the game and thereby contribute to the overall enjoyment of the card game 10. In addition, the scoring rows 28 may include a variable number of peg hole 22 rows. For example, each scoring row 28 may include one or more rows of peg holes.

The invention has been described in conjunction with several embodiments. It will be understood by those skilled in the art that various changes and modifications may be made without departing from the spirit of the invention. Furthermore, it is not intended that the invention be limited in any way to the embodiments shown and described. It is intended that the invention be limited in scope only in accordance with the claims appended hereto.

STATEMENT REGARDING COPYRIGHT PROTECTION

A portion of the disclosure of this patent document contains material to which a claim for copyright is made. The copyright owner has no objection to the facsimile reproduction by anyone of the patent document or the patent disclosure, as it appears in the Patent and Trademark Office patent files or records, but reserves all other copyrights whatsoever.

What is claimed is:

1. A method for playing a portable multi-player card game with a plurality of players, the method comprising the steps of:

a) engaging at least two players;

b) providing a deck of cards, having four sets of cards numbered from one to ten, wherein each set is uniquely marked, and one set has a certain numbered card designated as "chief";

c) dealing a multi-card hand to each player;

d) placing four cards, face up, in a center location upon beginning a first hand;

e) taking a turn by each player, the turn including:

e1) matching, in turn, one or more of the cards in the center location with the feature on one of the players' cards in the players' hand;

e2) arithmetically adding, in turn, the numbers of two or more of the cards in the center location to equal the numbered feature on one of the players' cards in the players' hand; and e3) discarding a card from the players' hand to the center location, when the players can not match a card or arithmetically add cards from the center location to one of the cards in the players' hand;

f) dealing additional multi-card hands to each player each time all of the players run out of cards in their hand; and g) awarding points to a player:

g1) immediately upon acquiring the card designated as "chief";

g2) immediately when the player takes the last card in the center location;

g3) having the most cards at the end of each game;

g4) having the most cards with a predetermined feature at the end of each game; and g5) having the highest value of his/her best four cards at the end of each game.

2. The method for playing a portable multi-player card game with a plurality of players of claim 1, wherein, after all the players' cards have been discarded, and all of the cards in the deck have been dealt, the remaining cards in the center location are given to the last player to have acquired cards from the center location via matching one or more of the cards in the center location with the feature on one of that player's cards in the player's hand.

3. The method for playing a portable multi-player card game with a plurality of players of claim 1, wherein, after all the players' cards have been discarded, and all of the cards in the deck have been dealt, the remaining cards in the center location are given to the last player to have acquired cards from the center location via arithmetically adding the numbers of two or more of the cards in the center location to equal the numbered feature on one of that player's cards in the player's hand.

4. The method for playing a portable multi-player card game with a plurality of players of claim 1, wherein the best four cards are the four cards in a player's trick pile at the end of the game with the highest cumulative number value among all the cards in his/her trick pile.

5. The method for playing a portable multi-player card game with a plurality of players of claim 1, wherein the additional point awarded to the player having the most cards is one point, the additional point awarded to the player having the most picture cards is one point, the additional point awarded to the player having a chief card is one point, and the additional point awarded to the player having the four best cards is one point.

6. The method for playing a portable multi-player card game with a plurality of players of claim 1, wherein the players' multi-card hand consists of three cards.

* * * * *